US010834981B2

(12) United States Patent
Kim

(10) Patent No.: US 10,834,981 B2
(45) Date of Patent: Nov. 17, 2020

(54) SPATS AND CRAMPONS

(71) Applicant: Cheon Ki Kim, Gyeonggi-do (KR)

(72) Inventor: Cheon Ki Kim, Gyeonggi-do (KR)

( * ) Notice: Subject to any disclaimer, the term of this patent is extended or adjusted under 35 U.S.C. 154(b) by 0 days.

(21) Appl. No.: 15/120,362

(22) PCT Filed: Oct. 28, 2014

(86) PCT No.: PCT/KR2014/010187
§ 371 (c)(1),
(2) Date: Aug. 19, 2016

(87) PCT Pub. No.: WO2015/126032
PCT Pub. Date: Aug. 27, 2015

(65) Prior Publication Data

US 2017/0065009 A1 Mar. 9, 2017

(30) Foreign Application Priority Data

Feb. 21, 2014 (KR) ..... 10-2014-0020653

(51) Int. Cl.
*A41D 17/00* (2006.01)
*A43C 15/06* (2006.01)

(52) U.S. Cl.
CPC ..... *A41D 17/005* (2013.01); *A43C 15/06* (2013.01); *A43C 15/063* (2013.01); *A43C 15/066* (2013.01)

(58) Field of Classification Search
CPC ..... A41D 17/00; A41D 17/005; A41D 17/02; A41D 17/04; A43C 15/06; A43C 15/066; A43C 15/061; A43C 15/068
USPC ..... 2/241, 22; 36/7.7
See application file for complete search history.

(56) References Cited

U.S. PATENT DOCUMENTS 342,152 A * 5/1886 Welton ..... A43B 3/02 36/1.5
793,955 A * 7/1905 Pynch ..... A41D 17/00 36/2 R
1,293,349 A * 2/1919 Cotter ..... A43C 15/06 36/7.6
1,652,750 A * 12/1927 Wohlgemuth ..... A41D 13/0002 2/210
2,406,090 A * 8/1946 Mas ..... A41D 17/00 36/2 R
2,786,208 A * 3/1957 Oberg ..... A41F 17/00 2/232
2,824,390 A * 2/1958 Walker ..... A43B 3/02 2/269

(Continued)

FOREIGN PATENT DOCUMENTS

CN 2144932 Y 11/1993
CN 201067100 Y 6/2008

(Continued)

OTHER PUBLICATIONS

International Search Report issued in a corresponding International Application No. PCT/KR2014/010187 dated Jan. 14, 2015.

*Primary Examiner* — Katharine Gracz
(74) *Attorney, Agent, or Firm* — Maschoff Brennan

(57) ABSTRACT

Spats comprise: a body, one end and the other end of which are attached to or detached from each other; an elastic line extending from the one end to the other end inside of the lower side of the body; and one or more hooks connected to the elastic line and exposed to the outside.

7 Claims, 5 Drawing Sheets

(56) References Cited

U.S. PATENT DOCUMENTS 3,153,864 A * 10/1964 Brewer ..... A41D 17/00 2/22
3,733,615 A * 5/1973 Jaffee ..... A41D 1/082 2/232
4,017,910 A * 4/1977 Bente ..... A41D 1/08 2/232
4,503,566 A * 3/1985 Wheeler ..... A41D 17/00 2/22
4,856,207 A * 8/1989 Datson ..... A41D 17/00 36/1.5
4,896,437 A * 1/1990 Johnson ..... A41D 17/00 2/22
5,016,290 A * 5/1991 Askew ..... A41F 1/00 2/270
5,251,386 A * 10/1993 Diaz ..... A41D 17/00 36/1.5
5,642,573 A * 7/1997 Brown ..... A41D 17/00 36/132
5,813,143 A * 9/1998 Bell ..... A43C 15/06 36/59 R
5,887,359 A * 3/1999 Falguere ..... A41D 17/00 36/1.5
6,185,752 B1 * 2/2001 Hendersen ..... A41D 17/00 2/23
6,301,803 B1 * 10/2001 Patterson ..... A41D 17/00 36/1.5
8,065,821 B1 * 11/2011 Reid ..... A43B 3/242 36/1.5
8,171,653 B1 * 5/2012 Pennington ..... A41D 17/005 36/1.5
8,745,765 B1 * 6/2014 Ahlborn ..... A41D 31/0055 2/22
2003/0192205 A1 * 10/2003 Linens ..... A43B 1/0027 36/100
2005/0198860 A1 * 9/2005 Larson ..... A43B 3/16 36/7.6
2005/0235522 A1 * 10/2005 Crowley, II ..... A41D 17/005 36/2 R
2006/0117598 A1 * 6/2006 Czaplewski ..... A41D 17/00 36/2 R
2006/0156577 A1 * 7/2006 Choi ..... A43C 15/063 36/7.6
2010/0139118 A1 * 6/2010 Park ..... A43B 5/001 36/7.6
2011/0258878 A1 * 10/2011 Jones ..... A43C 15/063 36/62
2012/0185998 A1 * 7/2012 Hagen ..... A41D 1/082 2/227
2013/0305565 A1 * 11/2013 Jones ..... A43B 5/185 36/62

FOREIGN PATENT DOCUMENTS

| | | | |
|---|---|---|---|
| CN | 103156311 | A | 6/2013 |
| DE | 296 15 158 | U1 | 11/1996 |
| EP | 2 382 887 | A2 | 2/2011 |
| JP | 3031278 | U9 | 9/1996 |
| JP | 3033856 | U | 2/1997 |
| JP | 3038336 | U9 | 3/1997 |
| JP | 19-228112 | A | 9/1997 |
| JP | 111-124711 | A | 5/1999 |
| KR | 20-0441279 | Y1 | 8/2008 |
| KR | 10-2009-0068420 | | 5/2010 |
| KR | 10-1305939 | B1 | 9/2013 |
| KR | 101351175 | B1 | 1/2014 |

* cited by examiner

[Fig. 1]
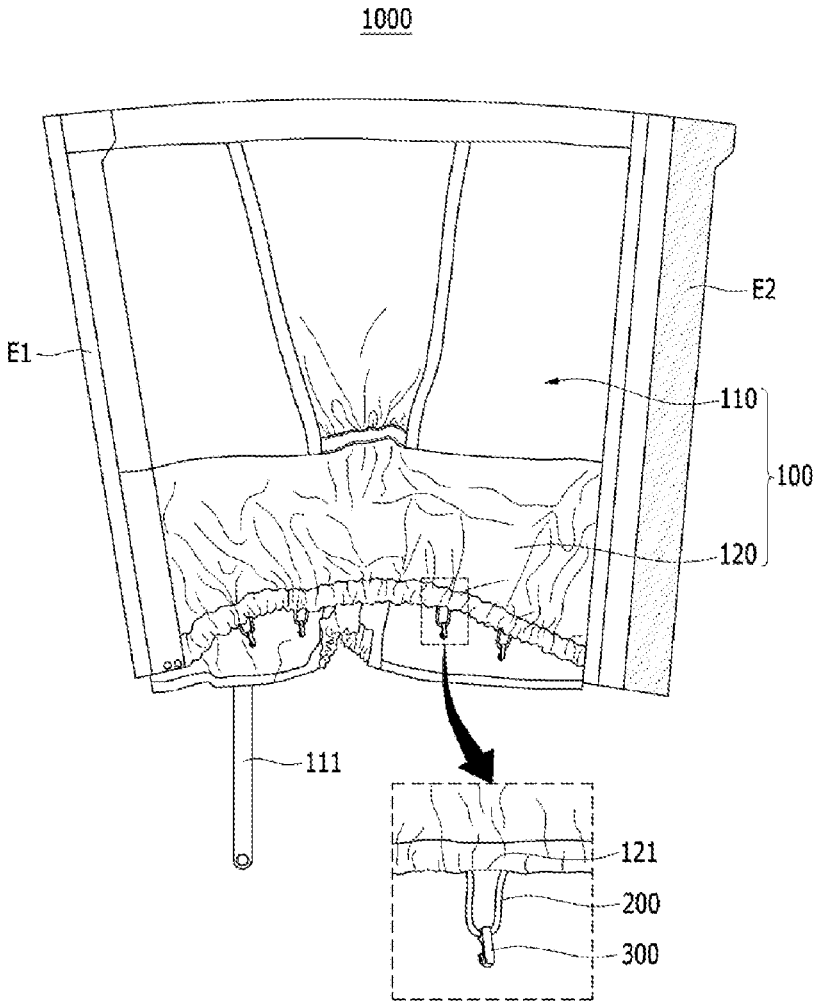

[Fig.2]
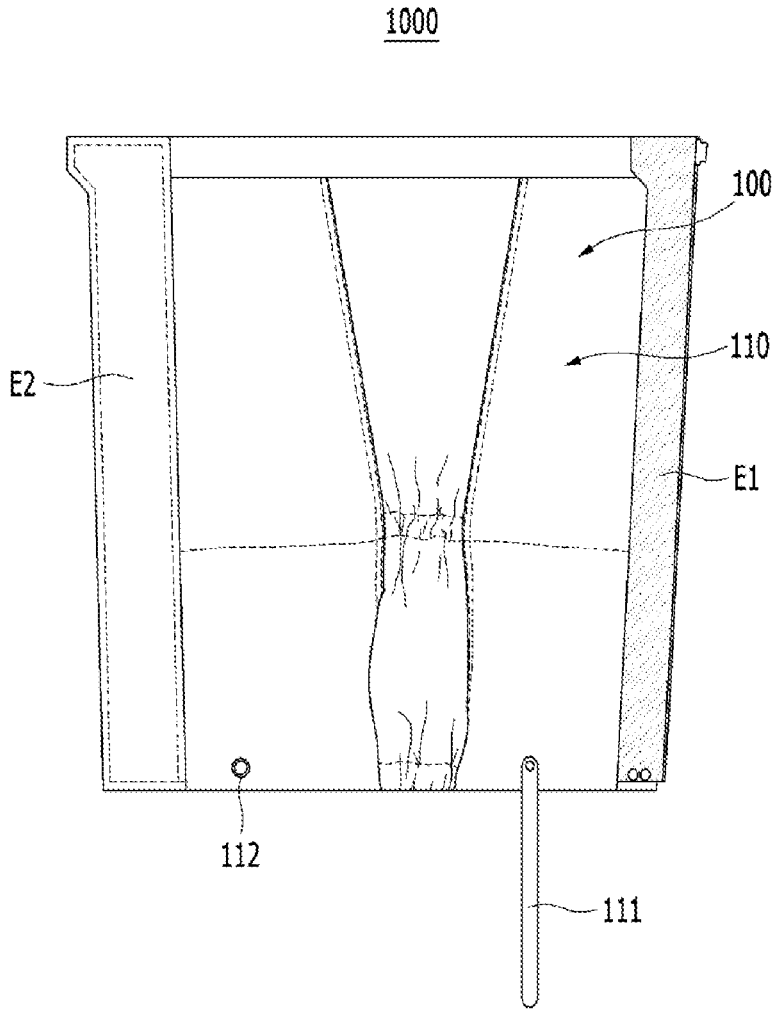

[Fig. 3]
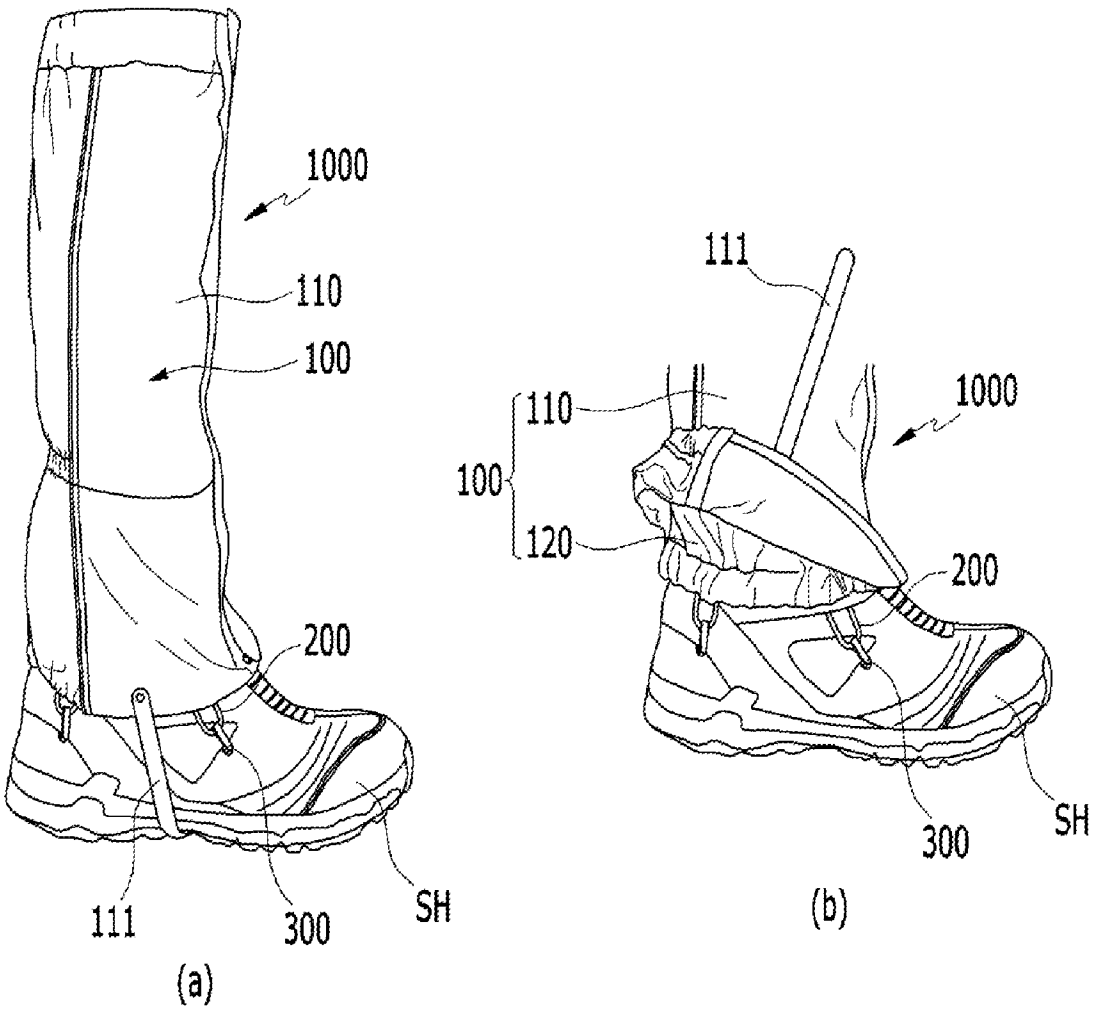

[Fig. 4]
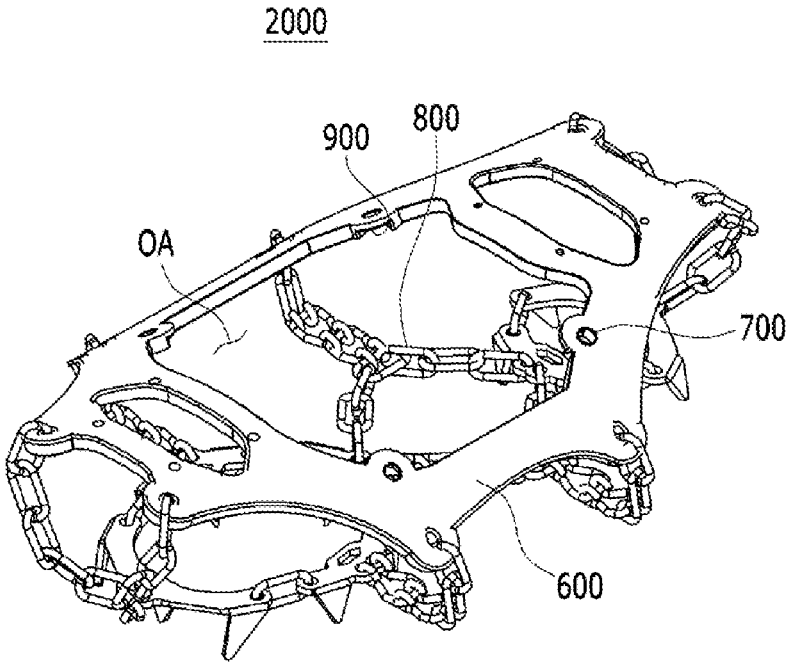
[Fig. 5]
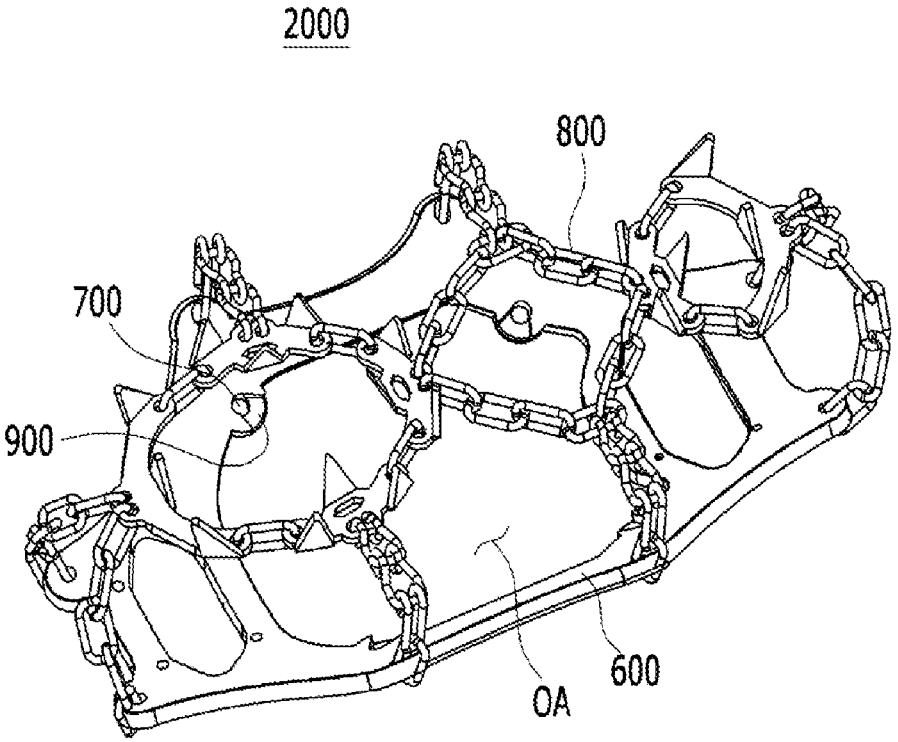

[Fig. 6]
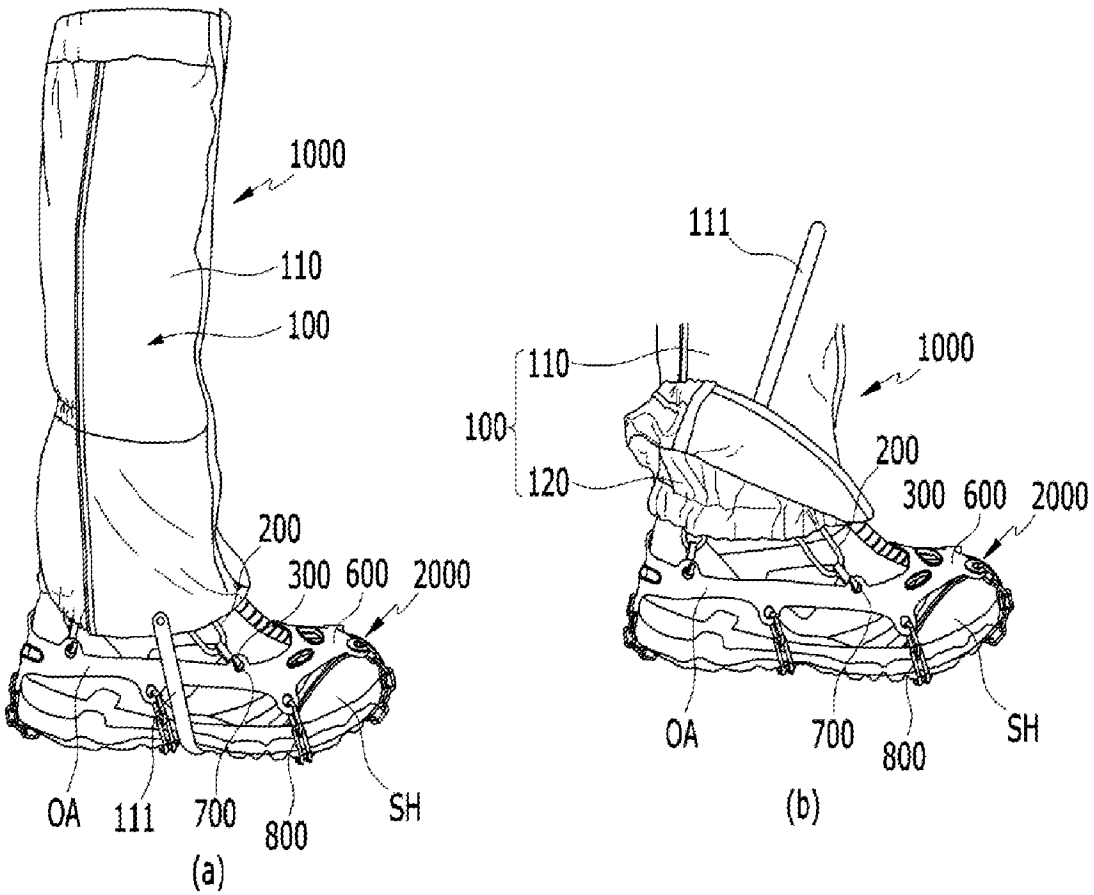

SPATS AND CRAMPONS

CROSS-REFERENCE TO RELATED APPLICATIONS

The present application is a U.S. National Phase of PCT/KR2014/010187 filed on Oct. 28, 2014 claiming priority to Korean Patent application No. 10-2014-0020653 filed on Feb. 21, 2014. The disclosure of the PCT Application is hereby incorporated by reference into the present Application.

TECHNICAL FIELD

The present invention relates to spats and crampons, and in particular to spats and crampons which are detachably attached to legs and shoes.

BACKGROUND ART

In general, a spat and a crampon are devices which are detachably attached to legs and shoes, of which the spat is detachably attached to legs, thus preventing snow, etc. from entering the insides of the shoes, and the crampon is detachably attached to the shoes, thus preventing the shoes from slipping on snowy or icy places.

For the sake of stable operations of such devices, the spats and crampons should be detachably attached stable to the legs and shoes.

DISCLOSURE OF INVENTION

Accordingly, according to an embodiment of the present invention, it is an object of the present invention to provide spats and crampons which can be detachably attached stable to legs and shoes.

To achieve the above objects, according to one aspect of the present invention, there are provided spats, which may include, but are not limited to, a body, one end and the other end of which are attached to or detached from each other; an elastic line extending from the one end to the other end inside of the lower side of the body; and one or more hooks connected to the elastic line and exposed to the outside.

The body is made of a flexible material.

The body is formed in a quadrangle shape, wherein an end of the body corresponds to one side of the quadrangle shape, and the other end of the body corresponds to the other side of the quadrangle shape.

The body may include an outer layer which include the one end and the other end thereof; and an inner layer which is connected to a portion of the inner side of the outer layer and is formed extending in a downward direction from a portion of the inner side of the outer layer, wherein an end of the lower side of the downward direction is disposed separated from the outer layer.

The inner layer is connected to the one end and the other end of the outer layer, respectively.

The elastic line is disposed in the inside of an end of the lower side of the inner layer.

The inner layer includes an exposed part which is configured to expose a portion of the elastic line to which the ring is connected.

The elastic line has a length which is shorter than the distance from the one end of the outer layer to the other end thereof.

The outer layer may include a band which extends in a downward direction from a portion of the lower side of the outer layer; and a band connection part which positions at the other portion of the lower side of the outer layer and is attached detachable to the end of the band.

To achieve the above objects, according to a second aspect of the present invention, there are provided crampons, which may include, but are not limited to, a flexible band which is configured to cover the edges of a shoe in a closed loop shape and includes an opening into which the shoe is inserted; one or more through holes which are provided at the flexible band part and are coupled with the ring of the aforementioned spat; and a chain peak part which is connected to the flexible band part and is configured to cover the shoe in a chain shape and includes a plurality of peaks.

The through hole is formed in proximity to the opening.

There may be further provided a concave part which extends from the through hole to the opening and contacts with the ring.

Advantageous Effects of the Invention

According to a part of the embodiment of the solutions of the present invention, spats and crampons are provided, which can be detachably attached stable to legs and shoes.

BRIEF DESCRIPTION OF DRAWINGS

FIG. 1 is a view illustrating an inside configuration of a spat according to a first embodiment of the present invention.

FIG. 2 is a view illustrating an outside configuration of a spat according to a first embodiment of the present invention.

FIG. 3 is a view illustrating spats which are detachably attached to legs according to a first embodiment of the present invention.

FIG. 4 is a view illustrating the upper side of a crampon according to a second embodiment of the present invention.

FIG. 5 is a view illustrating the lower side of a crampon according to a second embodiment of the present invention.

FIG. 6 is a view illustrating the cramps which are detachably attached to shoes according to a second embodiment of the present invention.

BEST MODES FOR CARRYING OUT THE INVENTION

The preferred embodiments of the present invention will be described with reference to the accompanying drawings to the extent that a person having ordinary skill in the art can easily carry out. It is obvious that the present invention may be implemented in various different ways, which are not limited to the embodiments below.

For the sake of clarified descriptions of the present invention, the components which are not related with the descriptions, will be omitted. The same or similar components throughout the specification will be given the same reference numbers.

Moreover, the size and thickness of each component illustrated in the drawings are randomly defined for the sake of convenient descriptions, and the present invention is not limited to the illustrated configurations.

In addition, the description that a predetermined component "comprises" another component means that unless otherwise stated herein, it should be interpreted as including another component, not excluding the inclusion of such a component.

The spats according to a first embodiment of the present invention will be described with reference to FIGS. 1 to 3. The spats which will be described from now on, can be detachably attached to user's legs when the user does various outdoor activities, for example, a mountain climbing, etc.

FIG. 1 is a view illustrating an inside configuration of a spat according to a first embodiment of the present invention. FIG. 2 is a view illustrating an outside configuration of a spat according to a first embodiment of the present invention. Referring to FIG. 1, the inside configuration of the spat corresponds to a portion which is directly facing the user's legs, and referring to FIG. 2, the outside configuration of the spat corresponds to a portion which is directly facing an external environment.

Referring to FIGS. 1 and 2, the spat 1000 according to a first embodiment of the present invention is configured to be detachably attached to a user's leg and may include, but is not limited to, a body 100, an elastic line 200, and a ring 300.

The body 100 may have a waterproof function and may be made of a flexible material to easily cover the user's legs. The body 100 may be formed in a quadrangle shape when it is exploded flat, wherein an end E1 is formed corresponding to one side of the quadrangle shape, and another end E2 is formed corresponding to another side of the quadrangle shape. As the one end and the other end of the body 100 are attached or detached to/from each other, the spats 1000 will be detachably attached covering the user's legs. An attachment and detachment member, for example, a Velcro, a button, etc. may be disposed at the one end E1 and the other end E2 of the body 100. Since the one end E1 and the other end E2 of the body 100 are easily attached or detached to/from each other with the aid of the attachment and detachment member, the spats 1000 can be easily and detachably attached to the user's legs.

The body 100 may include the outer layer 110 and the inner layer 120.

The outer layer 110 may include the one end E1 and the other end E2 and may be formed in a quadrangle shape, and the outer layer 110 may have a waterproof function. The outer layer 110 may include a band 111, and a band connection part 112.

The band 111 may be formed extending in a downward direction from a portion of the lower side of the outer layer 110, and the band connection part 112 may position at the other portion of the lower side of the outer layer 110. The end of the band 111 is formed detachable at the band connection part 112, and the end of the band 111 can be easily and detachably attached to the band connection part 112 with the aid of an attachment and detachment member, for example, a Velcro, a button or a ring.

Each of the band 111 and the band connection part 112 of the spat 1000 according to a first embodiment of the present invention may position at an outer side of the outer layer 110 of each spat 1000, and the band and the band connection part of the spat according to another embodiment of the present invention may position at an inner side of the outer layer of each spat.

The inner layer 120 may be formed extending in a downward direction of the body 100 from a predetermined portion of the inner side of the outer layer 110 (for example, a portion below an intermediate portion of the outer layer 110). The inner layer 120 is formed extending from the one end E1 to the other end E2 of the outer layer 110 and is connected to the one end E1 and the other end E2 of the outer layer 110. The end of the lower side in the downward direction of the inner layer 120 is disposed floating from the outer layer 110, so the end of the lower side of the inner layer 120 may be disposed separated from the outer layer 110.

An elastic line 200 may position at an inner portion of the lower side of the body 100 which corresponds to the end of the lower side of the inner layer 120, and the inner layer 120 may include an exposed part 121 which is able to expose to the outside a part of the elastic line 200 to which the ring 300 is connected.

The elastic line 200 is formed extending from the one end E1 of the outer layer 110 to the other end E2 in the inside of the end of the lower side of the inner layer 120. The elastic line 200 has an elasticity and may have a length which is shorter than the distance from the one end E1 to the other end E2 of the outer layer 110. For this reason, the end of the lower side of the inner layer 120 may have a length which is shorter than the end of the upper side connected to the outer layer 110 and has an elasticity from the elastic line 200.

The ring 300 is provided multiple in number and is connected to a part of the elastic line 200 exposed by the exposed part 121. The ring 300 is disposed exposed to the outside and may be attached to a shoe or a crampon in a state where it is connected to the elastic line 200.

Meanwhile, the spat according to another embodiment of the present invention may include only one ring.

FIG. 3 is a view illustrating a spat which is detachably attached to the leg according to a first embodiment of the present invention, of which FIG. 3A is a view illustrating a state where the outer layer of the spat is covering the upper portions of the shoe, and FIG. 3B is a view illustrating a state where the outer layer of the spat is removed from the upper portions of the show for the easier descriptions.

As illustrated in FIG. 3, the spats 1000 according to a first embodiment of the present invention are detachably attached to the legs.

The band 111 of the spat 1000 which is detachably attached to the leg, is connected through the bottom of the shoe (SH) to the band connection part 112. For this reason, the spat 1000 can be attached stable to the leg, and at the same time, any movement of the spat 1000 from the initially attached position can be inhibited to the maximum in case of any external interference or while a user is walking.

Moreover, the ring 300 of the spat 1000 detachably attached to the leg is coupled to the shoe (SH) in a state where it is connected to the elastic line 200, for which the lower portion among the whole portions of the spat 1000 can be supported stable by the shoe (SH). For this reason, the spat 1000 can be attached stable to the leg, and any movement of the spat 1000 from the initially attached position can be inhibited in case of any external interference or while a user is walking.

More specifically, the outer layer 110 can be detachably attached stable to the leg with the aid of the band 111 and the band connection part 112, and at the same time, the inner layer 120 can be detachably attached stable to the leg with the aid of the ring 300, by which the whole portions of the spat 1000 can be detachably attached stable to the leg. For this reason, any movement of the spat 1000 from the initially attached position can be inhibited in case of any external interference or while a user is walking.

Moreover, the ring 300 of the spat 1000 which is attached to the leg is detachably attached to the shoe (SH) in a state where it is connected to the elastic line 200, for which the length of the elastic line 200 which positions at the end of the lower side of the inner layer 120, may decrease, and then the length of the end of the lower side of the inner layer 120 may decrease, by which the end of the lower side of the inner layer 120 can contact close with an upper portion of the shoe (SH). Since the inner layer 120 contacts close with the upper portion of the shoe (SH), even if a foreign substance, for example, snow or leaves, externally penetrates through the outer layer 110 into the inner layer 120, it can be possible to prevent such a foreign substance from entering through the inner layer 120 into the inside of the shoe (SH) or the inside of the inner layer 120. Namely, the present invention is able to provide the spat 1000 which is able to be detachably attached stable to the leg, thus preventing a foreign substance, for example, snow, etc. from entering the inside of the shoe (SH).

The crampons according to a second embodiment of the present invention will be described with reference to FIGS. 4 to 6. The crampon according to a second embodiment of the present invention is coupled to the ring of the spat according to a first embodiment of the present invention.

FIG. 4 is a view illustrating the upper side of a crampon according to a second embodiment of the present invention. FIG. 5 is a view illustrating the lower side of a crampon according to a second embodiment of the present invention.

Referring to FIGS. 4 and 5, the crampon 2000 according to a second embodiment of the present invention is detachably attached to a shoe and is configured to prevent any slip of the shoe and may include, but is not limited to, a flexible band part 600, a through hole 700, a concave part 900 and a chain peak part 800.

In the flexible band part 600, the edge of the shoe is covered in a closed loop shape, and an opening (OA) may be formed, into which the shoe is inserted. The flexible band part 600 may be made of a rubber having a predetermined elasticity. Since the flexible band part 600 has a flexible characteristic and an elasticity, the shoe can be easily inserted through the opening (OA) into the inside of the crampon 2000, and the flexible band part 600 can contact close with the shoe after the shoe has been inserted into the inside of the crampon 2000.

The through hole 700 may be formed at the flexible band part 600 and may be formed in proximity to the opening (OA). The through hole 700 may be engaged to the ring of the spat according to a first embodiment of the present invention.

The concave part 900 may be formed at a lower portion of the flexible band part 600 and may be formed extending in the direction from the through hole 700 to the opening (OA). The concave part 900 may contact with the ring of the spat according to a first embodiment of the present invention. Since the ring of the spat position at the concave part 900, the ring can be inhibited from exposing to the outside of the surface of the flexible band part 600.

The chain peak part 800 may be connected to the flexible band part 600 while covering the front part, the rear part, the side part and the bottom part of the shoe in a chain shape and may include a plurality of peaks which are formed at the portions to which the chains are coupled. The chain peak part 800 may be made of a metallic material, but it is not limited thereto. It may be preferably made of a plastic material, a rubber, a ceramic material, a synthetic material, etc.

FIG. 6 is a view illustrating the cramps which are detachably attached to shoes according to a second embodiment of the present invention.

Referring to FIG. 6, the crampon 2000 according to a second embodiment of the present invention may be detachably attached to the shoe (SH) together with the spat 1000. FIG. 6A is a view illustrating a state where the outer layer of the spat is covering the upper side of the shoe, and FIG. 6B is a view illustrating a state where the outer layer of the spat is removed from the upper side of the shoe for the sake of easier descriptions.

The ring 300 of the spat 1000 may be coupled to the through hole 700 of the crampon 2000 attached to the shoe (SH). For this reason, the spat 1000 and the crampon 2000 can be supported stable from each other, by which the spat 1000 can be detachably attached stable to the leg, and at the same time, the crampon 2000 can be detachably attached stable to the shoe (SH), any movement of the spat 1000 and the crampon 2000 from their initially attached positions can be prevented in case of any external interference or while a user walking.

Moreover, since the ring 300 coupled to the through hole 700 position at the concave part 900 (illustrated in FIG. 5), the ring 300 can be exposed to the outside of the surface of the flexible band part 600, so any interference with the shoe (SH) can be prevented. In this way, any separation of the ring 300 from the through hole 700 can be prevented in case of any external interference or while a user is walking. More specifically, any movement of the spat 1000 and the crampon 2000 from their initially attached positions can be inhibited in case of an external interference of while a user is walking.

Since the ring 300 of the spat 1000 is coupled to the through hole 700 of the crampon 2000, and the spat 1000 and the crampon 2000 can be supported stable, any movement of the spat 1000 and the crampon 2000 from their initially attached positions can be inhibited. For this reason, the spat 1000 is able to prevent a predetermined foreign substance, for example, snow, leaves, etc. from entering the inside of the shoe (SH), by which the crampon 2000 attached to the shoe (SH) can prevent the shoe (SH) from slipping on a slippery place, for example, a snowy or icy place.

Moreover, since the ring 300 of the spat 1000 attached to the leg is coupled to the through hole 700 of the crampon 2000 in a state where it is connected to the elastic line 200, the lower side portions among the whole portions of the spat 1000 can be supported stable by the shoe (SH), whereby the spat 1000 can be attached stable to the leg and at the same time, any movement of the spat 1000 from its initially attached position can be prevented in case of any external interference or while a user is walking. More specifically, the outer layer 110 can be attached stable to the leg with the aid of the band 111 and the band connection part 112, and at the same time, the inner layer 120 can be attached stable to the leg with the aid of the ring 300 coupled to the through hole 700 of the crampon 2000, by which the whole portions of the spat 1000 can be attached stable to the leg. In this way, any movement of the spat 1000 from its initially attached position can be inhibited in case of an external interference or while a user is walking.

Moreover, since the ring 300 of the spat 1000 attached to the leg is coupled to the through hole 700 of the crampon 2000 in a state where it is connected to the elastic line 200, the length of the elastic line 200 which position in the inside of an end of the lower side of the inner layer 120, may decrease, so the length of the end of the lower side of the inner layer 120 may decrease, by which the end of the lower side of the inner layer 120 can contact close with the upper portions of the shoe (SH). Since the inner layer 120 contacts close with the upper portions of the shoe (SH), even though a predetermined foreign substance, for example, snow, leaves, etc. enters through the outer layer 110 into the inner layer 120, the foreign substance, for example, snow, leaves, etc. can be prevented from entering through the inner layer 120 into the inside of the shoe (SH) or the inner layer 120.

Namely, the present invention provides the spat 1000 which is detachably attached stable to the leg and is able to prevent a predetermined foreign substance, for example, snow, etc. from entering the inside of the shoe (SH).

As described above, the ring 300 of the spat 1000 is coupled to the through hole 700 of the crampon 2000, and the spat 1000 and the crampon 2000 are supported stable to each other, so the present invention can provide the spat 1000 and the crampon 2000 which are detachably attached stable to the leg and the shoe (SH).

While the present invention has been described by way of the preferred embodiments, the present invention is not limited thereto. It is obvious to a person having ordinary skill in the art that various modifications and changes are available unless such modifications and changes are out of the concept and scope of the claims of the present invention below.

The invention claimed is:

1. Spats, comprising:

a body, one end and another end of which are attached to or detached from each other;

an elastic line extending from the one end to the other end inside of the lower side of the body; and a plurality of rings connected to the elastic line and exposed to the outside, wherein the body comprises:

an outer layer which includes the one end and the other end thereof; and an inner layer which is connected to a portion of the inner side of the outer layer and is formed extending in a downward direction from the portion of the inner side of the outer layer, wherein an end of the lower side of the inner layer is disposed separated from the outer layer, wherein the elastic line is disposed within an end portion of the lower side of the inner layer and the elastic line extends from one end to another end of the lower side of the outer layer within the end portion of the lower side of the inner layer, and wherein the inner layer includes a plurality of opening parts formed at the end portion of the lower side of the inner layer such that a portion of the elastic line disposed within the end portion of the lower side of the inner layer is exposed through the opening parts and the portion of the elastic line exposed through the opening parts is connected to each of the plurality of rings such that when the plurality of rings of the spats are detachably attached to a shoe, a length of the elastic line disposed in the end portion of the lower side of the inner layer decreases.

2. The spats of claim 1, wherein the body is made of a flexible material.

3. The spats of claim 1, wherein the body is formed in a quadrangle shape, wherein an end of the body corresponds to one side of the quadrangle shape, and the other end of the body corresponds to the other side of the quadrangle shape.

4. The spats of claim 1, wherein the inner layer is connected to the one end and the other end of the outer layer, respectively.

5. The spats of claim 1, wherein the elastic line has a length which is shorter than the distance from the one end of the outer layer to the other end thereof.

6. The spats of claim 1, wherein the outer layer comprises:

a band which extends in a downward direction from a portion of the lower side of the outer layer; and a band connection part which positions at the other portion of the lower side of the outer layer and is attached detachable to the end of the band.

7. Crampons, comprising:

a flexible band which is configured to cover the edges of a shoe in a closed loop shape and includes an opening into which the shoe is inserted;

one or more through holes which are provided at the flexible band part and are coupled with the plurality of rings of the spats of claim 1, wherein the through hole is formed in proximity to the opening;

a chain peak part which is connected to the flexible band part and is configured to cover the shoe in a chain shape and includes a plurality of peaks; and a concave part which extends from the through hole to the opening and contacts with the plurality of rings, wherein the concave part is formed at a lower portion of the flexible band.

* * * * *